US008439163B2

(12) United States Patent
Inman

(10) Patent No.: US 8,439,163 B2
(45) Date of Patent: May 14, 2013

(54) LADDER SAFETY DEVICES

(76) Inventor: Denver Inman, Shelbyville, IN (US)

( * ) Notice: Subject to any disclaimer, the term of this patent is extended or adjusted under 35 U.S.C. 154(b) by 530 days.

(21) Appl. No.: 12/485,523

(22) Filed: Jun. 16, 2009

(65) Prior Publication Data

US 2010/0219017 A1 Sep. 2, 2010

Related U.S. Application Data

(60) Provisional application No. 61/061,742, filed on Jun. 16, 2008.

(51) Int. Cl.
*E04G 5/02* (2006.01)

(52) U.S. Cl.
USPC ..... 182/107; 182/206

(58) Field of Classification Search ..... 182/107, 182/206, 129, 230, 214, 229, 93; 248/210, 248/211, 48.1; 52/11–16
See application file for complete search history.

(56) References Cited

U.S. PATENT DOCUMENTS 3,006,321 A * 10/1961 Bailey ..... 119/61.2
3,052,442 A * 9/1962 Rankin, Jr. ..... 248/210
3,208,173 A * 9/1965 Shank ..... 40/592
4,428,493 A * 1/1984 McDonough ..... 220/555
4,580,661 A * 4/1986 Thomson, Jr. ..... 182/107
5,181,683 A * 1/1993 Smith ..... 248/231.31
5,358,071 A * 10/1994 Stennett ..... 182/214
5,496,005 A * 3/1996 Dieringer ..... 248/74.2
5,497,848 A * 3/1996 Travis ..... 182/107
5,509,500 A * 4/1996 Delagera ..... 182/107
5,628,381 A * 5/1997 Markovich et al. ..... 182/107
5,899,023 A * 5/1999 Byer ..... 52/12
5,971,100 A * 10/1999 DeLeon et al. ..... 182/107
6,138,963 A * 10/2000 Malvasio ..... 248/111
6,244,551 B1 * 6/2001 Fletcher ..... 248/238
6,254,039 B1 * 7/2001 Zimmerman ..... 248/48.2
7,950,497 B2 * 5/2011 Horton ..... 182/107
2003/0183450 A1 * 10/2003 Bonafide ..... 182/107
2005/0045421 A1 * 3/2005 Gaines ..... 182/107
2006/0032707 A1 * 2/2006 Sais ..... 182/107
2006/0243525 A1 * 11/2006 Bengston ..... 182/107
2007/0163836 A1 * 7/2007 Jurovich ..... 182/107
2007/0251762 A1 * 11/2007 Charlton ..... 182/107
2009/0188750 A1 * 7/2009 Charlton ..... 182/107
2009/0242327 A1 * 10/2009 Tracy ..... 182/107
2010/0116589 A1 * 5/2010 Mathieson ..... 182/107

* cited by examiner

*Primary Examiner* — Katherine Mitchell
*Assistant Examiner* — Johnnie A Shablack
(74) *Attorney, Agent, or Firm* — Brannon Sowers & Cracraft PC

(57) ABSTRACT

Ladder safety devices including a gutter guard, a ladder extender, a ground spike and a ladder shoe, are described that improve the stability of a ladder placed against a structure with or without guttering. Embodiments of the gutter guard prevent the ladder from contacting the gutter, distribute the ladder's weight to minimize structural damage, avoid ladder-gutter contact resulting in and help to hold the ladder in place. The ladder extender offsets the ladder from the shingles of a roof when gutters are not present. The ground spike and ladder shoe stabilize a ladder placed on a soft or hard surfaces, respectfully.

15 Claims, 7 Drawing Sheets

LADDER SAFETY DEVICES

This application claims the benefit of U.S. Provisional Application No. 61/061,742, filed Jun. 16, 2008, which is hereby incorporated by reference.

FIELD OF THE DISCLOSURE

The present disclosure relates to the field of ladders. More particularly, but not exclusively, the present disclosure relates to safety and stabilizing devices for ladders.

BACKGROUND OF THE DISCLOSURE

Ladder safety is an ever-growing concern in the construction industry, as well as for individual home-owners who use ladders. Once an individual is up on a ladder, the ladder can become unstable in a variety of ways potentially injuring the individual or causing damage to the surrounding structure. Additionally, ladders positioned up against gutters can cause damage to the gutters due to the force the ladder exerts on the gutter and the direct contact between the items.

Accordingly, there exists a need for improved safety and stabilizing devices for ladders which may also provide gutter protection during use of the ladder.

SUMMARY

In broad terms, a first aspect of the present disclosure provides for a gutter hook for engaging a ladder and a gutter installed upon a structure, typically a building. When properly utilized, the gutter hook is positioned between the ladder and the gutter, preventing contact between the ladder and the gutter. Use of the gutter hook prevents structural and surface damage to the gutter and increases ladder stability. The gutter hook is made from a polymeric material to cushion contact with the gutter. The gutter hook comprises a member having a ladder portion, an adjacent gutter portion and a cut-out-portion proximate the gutter and ladder portions adapted to engage at least one edge of the gutter. The ladder portion has a ladder engaging channel opposite the gutter portion to receive and maintain a single ladder beam therein. Proper use of the gutter hook requires two units, one for each of the two ladder beams.

For one embodiment of the gutter hook, the cut-out-portion is a narrow channel substantially conforming to a front edge of the gutter and the gutter portion is adapted to fit within and fill the gutter. This embodiment is particularly suited for use with gutters that do not have leaf guards installed. For this embodiment, the weight of the ladder and its occupant is born by the front, back, and bottom of the gutter and deflection of the front edge of the gutter is minimized because the gutter is substantially filled with the gutter portion of the gutter guard.

For a further embodiment of the gutter hook, the cut-out-portion is a broad channel conforming substantially to a front edge and an upper surface of the gutter and the gutter portion is adapted to fit over a leaf guard fitted onto the gutter. This embodiment is particularly suited for use with gutters that have leaf guards installed. For this embodiment, the weight of the ladder and its occupant is born by the front of the gutter and the leaf guard fitted over the top of the gutter. Proper use of this embodiment of the gutter hook requires two units, one for each of the two ladder beams.

A further aspect of the current disclosure involves a ladder extender for engaging a ladder and a gutter board to provide an offset to the ladder and protect shingles from contact with a ladder in the absence of a gutter. Preferred ladder extenders are made from a polymeric material. One embodiment of the ladder extender involves a member having a ladder portion and an adjacent gutter board portion, the ladder portion having a ladder engaging channel opposite the gutter board portion for receiving and maintaining a single ladder beam therein. When properly installed the gutter board portion is adapted to fit against the gutter board and position or offset the ladder away from the shingles while providing proper support and stability for the ladder. Proper use of the ladder extender requires two units, one for each of the two ladder beams.

A further aspect of the current disclosure involves a ground spike for positioning against the bottom of a ladder beam to add stability to the ladder. Although the ground spike can be made from a variety of materials, polymeric materials are preferred, particularly rigid and hard polymeric materials. The ground spike is particularly useful for safely positioning a ladder on soft surfaces such as the ground in a yard. Aspects of the preferred ground spike are described in detail below.

A further aspect of the current disclosure involves a ladder shoe for positioning against the bottom of a ladder beam to add stability to the ladder placed on a hard surface such as concrete, a wood deck, or a driveway surface. Although the ladder shoe can be made from a variety of materials, polymeric materials are preferred, particularly rigid and hard polymeric materials having non-skid properties. The ladder shoe is particularly useful for safely positioning a ladder on hard surfaces. Aspects of the preferred ladder shoe are described in detail below.

Finally, a still further aspect of the present disclosure involves a kit having members for stabilizing a ladder. Preferred kits include at least two members selected from the group consisting of (a) a gutter hook; (b) a ladder extender; (c) a ground spike; and (d) a ladder shoe. Preferred kits are packaged in a bubble wrap manner allowing the kit's contents to be visible without opening the packaging.

DESCRIPTION OF ILLUSTRATED EMBODIMENTS

Figure 1:
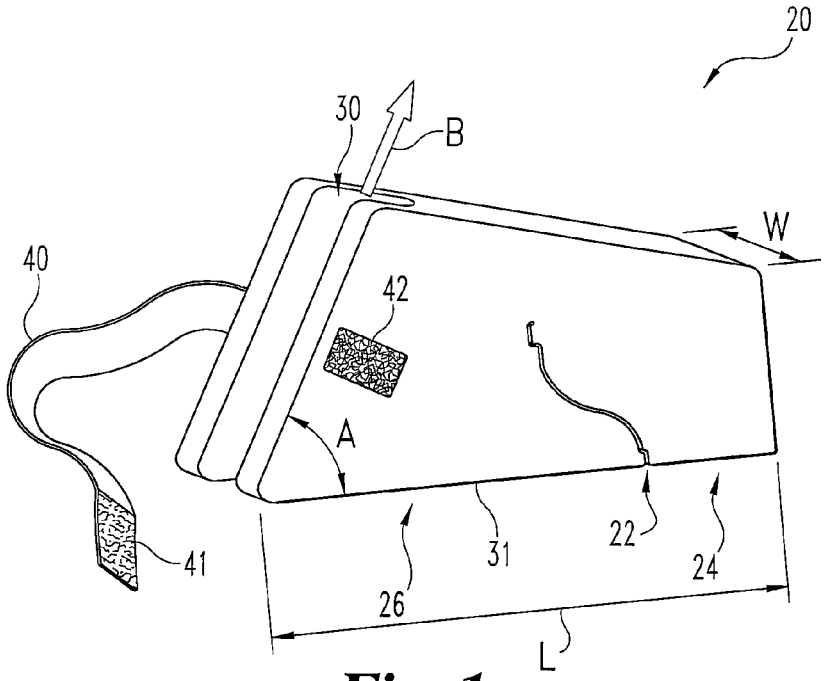
FIG. 1 is a perspective view of a ladder safety device.
Figure 2:
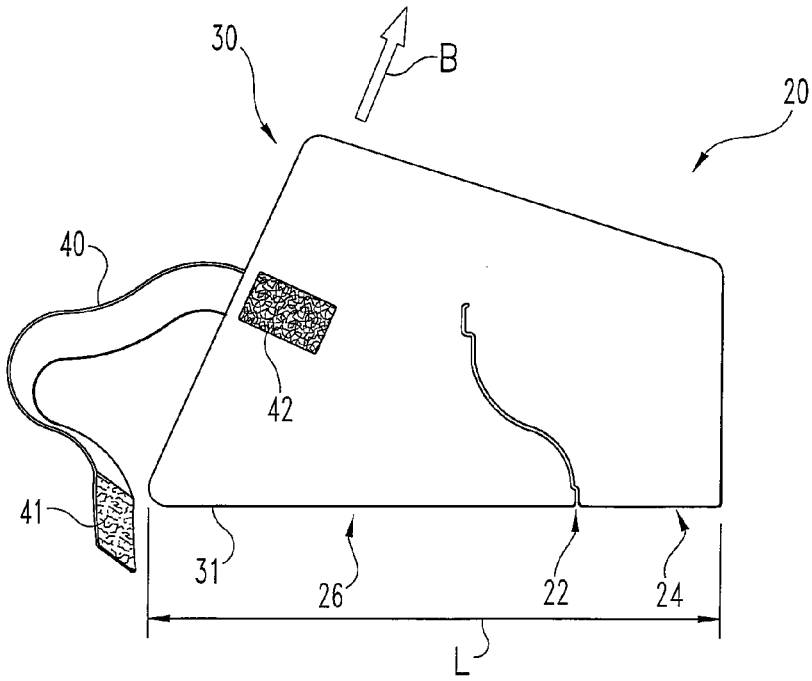
FIG. 2 is a side view of the ladder safety device of FIG. 1.
Figure 3:
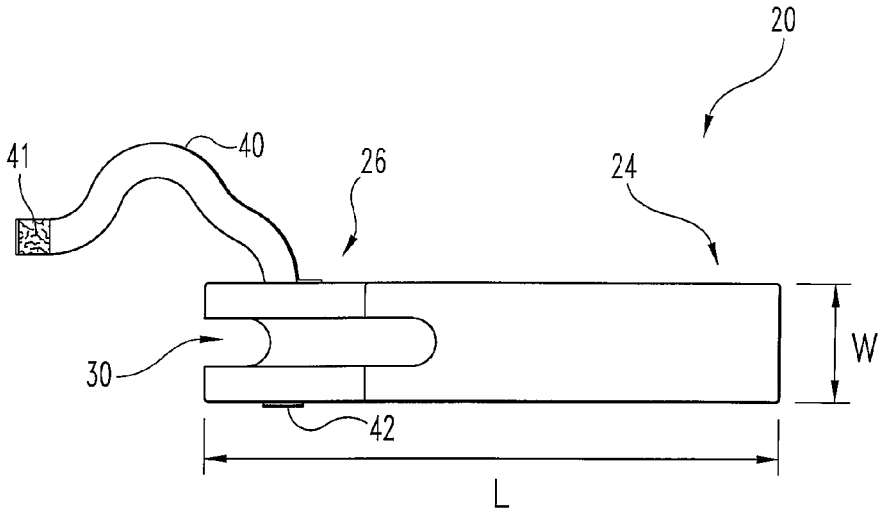
FIG. 3 is a top view of the ladder safety device of FIG. 1.

For the purpose of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates.

The present disclosure describes a plurality of ladder safety devices. Each of the ladder safety devices will be described as a single item; however, it should be appreciated that each of the devices is designed to be utilized as one item in a pair of items corresponding to the two ladder beams of a ladder. The various devices described herein may be used separately or in combination as desired. Additionally, two or more of the different ladder safety devices described herein may be combined as a kit. The devices seek to add stability to a ladder during use. Additionally, a few of the devices provide protection to a gutter which the ladder may contact during use.

Referring generally to FIGS. 1-4, there is shown a first ladder safety and stabilizing device, gutter hook 20. Gutter hook 20 is configured to engage a gutter as well as a ladder beam to provide stability to the ladder and protect the gutter. Hook 20, having length L and width W, includes a cut-out portion 22 separating a gutter portion 24 for positioning in a gutter and a ladder portion 26 for engaging a ladder beam. Portion 22 extends the entire width W of hook 20 and is designed to snugly or tightly fit over the outer gutter wall, with portion 24 resting within the gutter. In preferred embodiments, portion 22 is cut out of hook 20 in a shape and size directly corresponding to the shape and size of the gutter wall. Accordingly, portion 22 may be configured differently than as illustrated according to the particular gutter with which hook 20 is being used.

Portion 26 defines a slot or channel 30 extending along a beam axis B in which a ladder beam is positioned. Accordingly, hook 20 protects the gutter from direct contact with the ladder beam, provides weight distribution, and further provides safety to the user on the ladder as the ladder is engaged with the gutter. Channel 30 may be sufficiently deep such that the entire ladder beam is positioned within the channel or the channel may be designed such that only a part of the ladder beam rests within the channel. Beam axis B and channel 30 form an angle A with respect to bottom surface 31 of hook 20. In certain embodiments, it is desirable to position ladders at around a 15 degree angle with the vertical surface that that the ladder contacts near its top end. Accordingly, in certain embodiments, angle A is around 75 degrees. However, it should be appreciated that hook 20, including channel 30, can be sized, shaped, configured, orientated and proportioned differently as would generally occur to one skilled in the art.

To further increase the safety for a user on the ladder, hook 20 may optionally include a system, mechanism or device to assist in retaining the ladder beam within channel 30. An example retaining mechanism is illustrated in FIG. 1 via strap 40. In the illustrated embodiment, strap 40 is configured to wrap around the ladder beam and includes a section of hook and loop fasteners 41 configured to engage a section of hook and loop fasteners 42 on the hook. It should be appreciated that the strap can be larger or wider than as illustrated. In other embodiments, one or more snaps could be used to attach the end of the strap to the body of the hook. Other example retaining mechanisms include two straps or strings which can be tied together around the ladder beam or any other type of retaining mechanism which wraps around the ladder beam to generally keep the ladder positioned within the channel. Additionally, another example retaining mechanism would be one or more magnets positioned within channel 30 which are operable to magnetically adhere to the ladder beam to assist in retaining the ladder beam in the channel.

Figure 4:
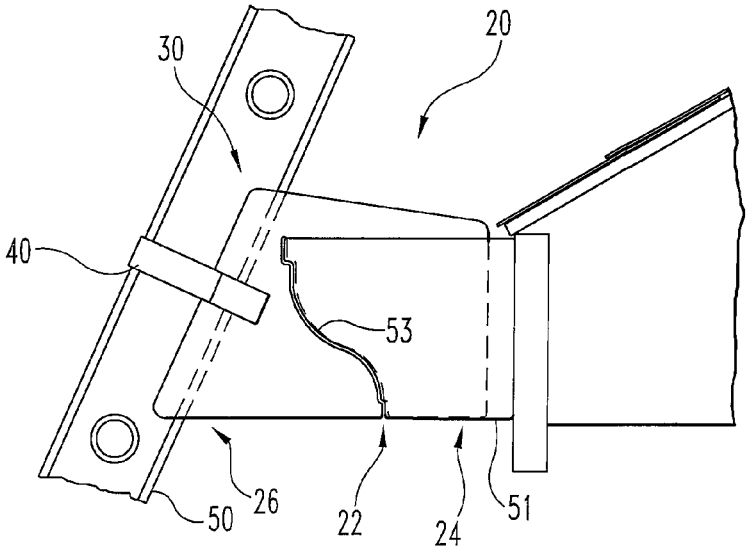
FIG. 4 is a side view of the ladder safety device of FIG. 1 in use.

Specifically referring to FIG. 4, here is shown an example arrangement of hook 20 engaging a ladder beam 50 and a gutter 51. As illustrated, cut-out portion 22 is snugly positioned over gutter wall 53, with most of gutter portion 24 of hook 20 resting within the gutter. Additionally, channel 30 is configured to receive ladder beam 50. The illustrated arrangement provides safety to an individual on the ladder and protects the gutter from direct contact with the ladder that might cause damage to the gutter.

Figure 5:
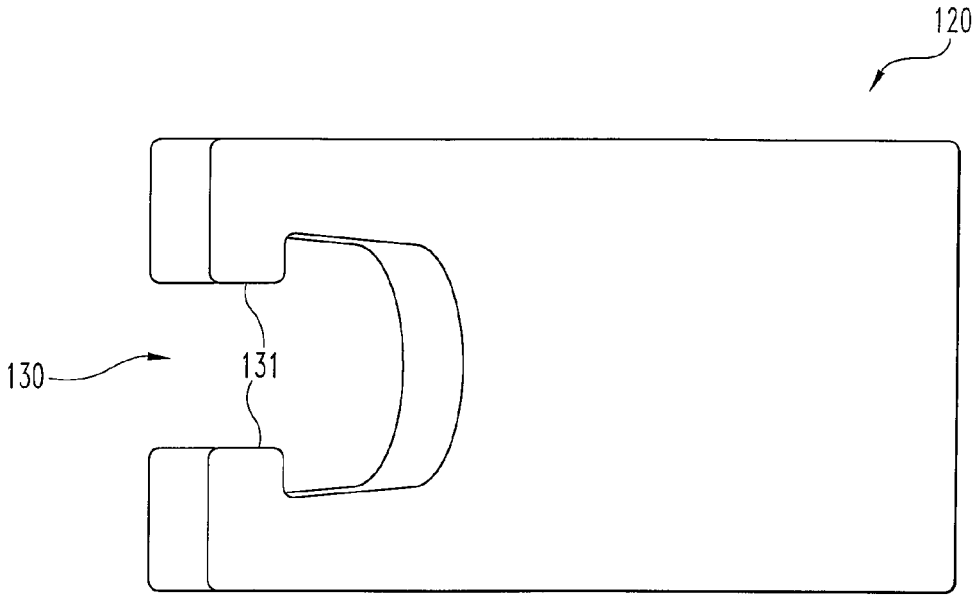
FIG. 5 is a top view of another ladder safety device.
Figure 6:
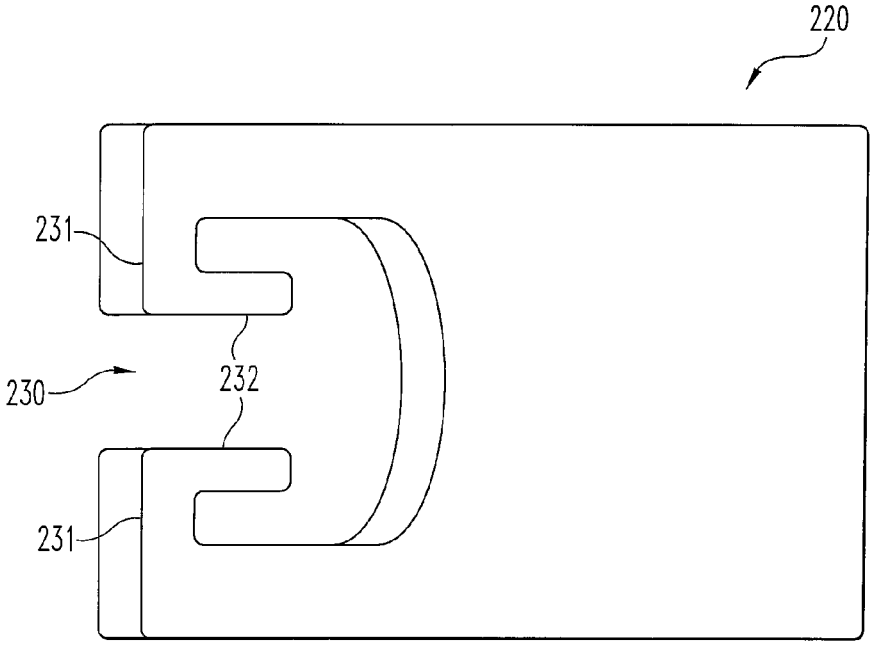
FIG. 6 is a top view of yet another ladder safety device.

FIGS. 5 and 6 illustrate example alternative configurations for the ladder beam channel of the hook device. More specifically, FIG. 5 illustrates hook 120 having extension portions 131 partially defining channel 130. Portions 131 extend inward into channel 130 toward each other to partially wrap around the ladder beam to hold the ladder beam in position. Additionally, FIG. 6 illustrates hook 220 having extension portions 231 and 232 partially defining channel 230. Portions 231 and 232 extend inward into channel 230 toward each other and back toward the gutter portion of the hook to partially wrap around the ladder beam to hold the ladder beam in within the channel. Channels 30, 130 and 230 of hooks 20, 120 and 220 are only a few examples of the numerous possible configurations of the channel defined in the gutter hook.

Figure 7:
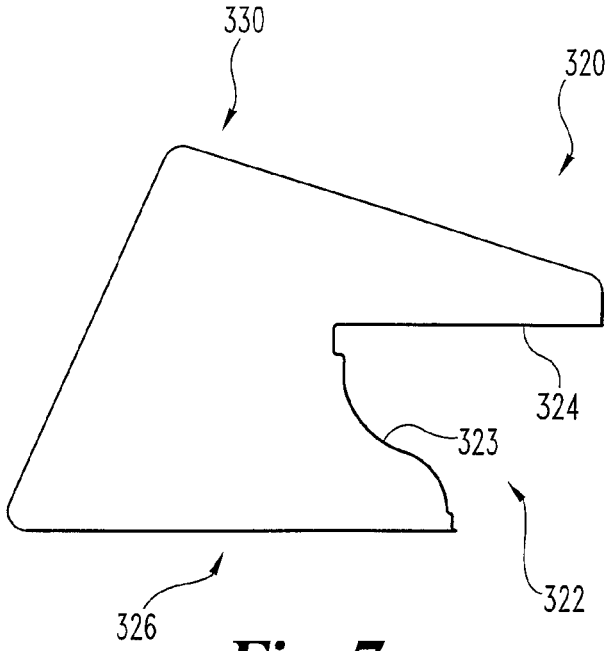
FIG. 7 is a side view of a further ladder safety device.
Figure 8:
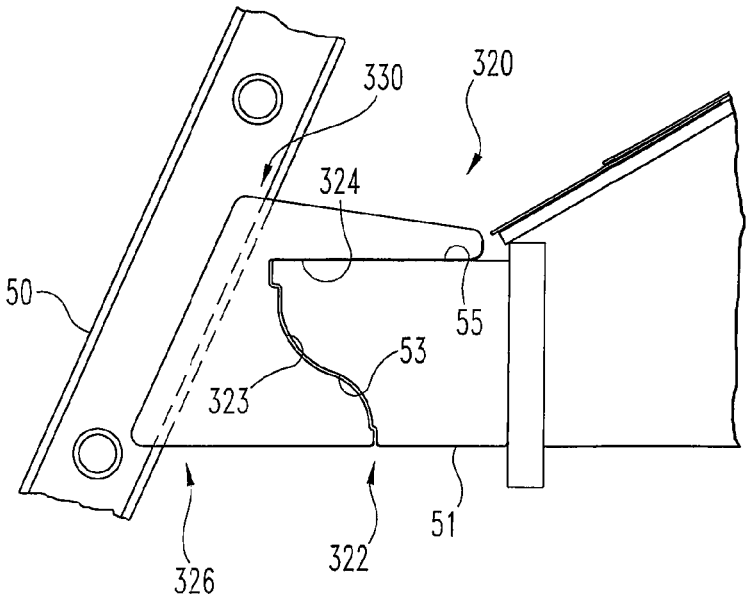
FIG. 8 is a side view of the ladder safety device of FIG. 7 in use.

FIGS. 7-8 illustrate a ladder safety and stabilizing device or gutter hook 320 configured for use with gutters having leaf guards or other similar protective coverings which prevent access to the interior of the gutter channel. Hook 320 includes a cut-out portion 322 defined by a generally vertical surface 323 and a generally horizontal surface 324. Surface 323 is configured and shaped to abut the outer surface of the gutter wall 53 and surface 324 is configured to abut the protective covering on gutter 51, such as a leaf guard 55. Similar to hook 20, hook 320 includes a channel 330 configured to receive the ladder beam. It should be appreciated that hook 320 may be sized, shaped, configured, orientated and proportioned differently as would generally occur to one skilled in the art, such that the hook may be used in conjunction with gutters having protective coverings. It is additionally contemplated that the hook 320 could include a securing mechanism to secure the hook and the ladder beam together. There are various types of securing mechanisms which could be used as would generally occur to one skilled in the art. As an example, a strap attached to the hook could be used to wrap around the ladder beam and secure the components together to provide added stability to the ladder during use.

It should be appreciated that gutter hooks 20, 120, 220, and/or 320 may be provided in a variety of different sizes. In certain embodiments, the gutter hooks may be sized to correspond to a typical 5 inch gutter. Additionally, in certain embodiments the gutter hooks may be sized to correspond to a typical 6 inch gutter. In a particular embodiment, the distance between the innermost surface of the channel and the outermost top edge of the gutter wall is around ¾ of an inch. In other words, the gutter hook functions to offset the ladder beam a distance of about ¾ of an inch from the top edge of the outer gutter wall. Additionally, in certain embodiments use of the gutter hooks functions to position the ladder a distance of around 5 inches from the roof line for a typical 5 inch gutter and a distance of around 6 inches from the roof line for a typical 6 inch gutter.

Figure 9:
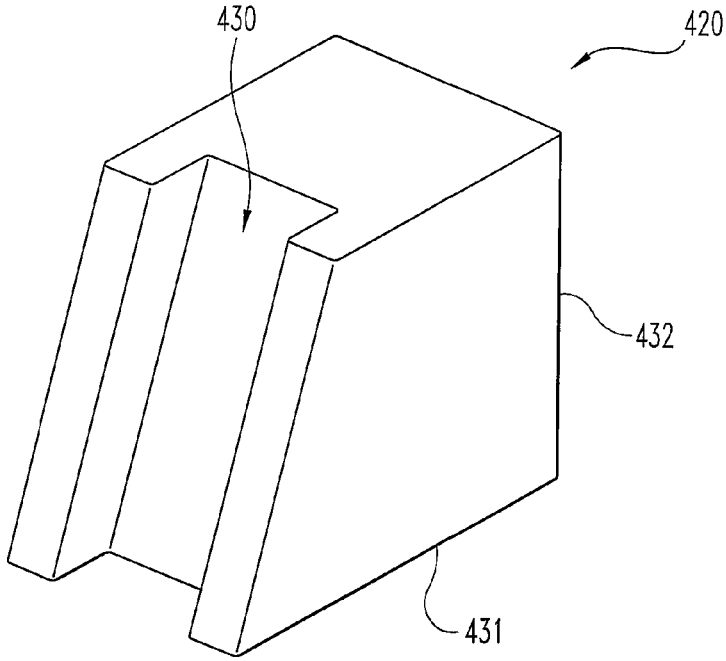
FIG. 9 is a perspective view of even another ladder safety device.
Figure 10:
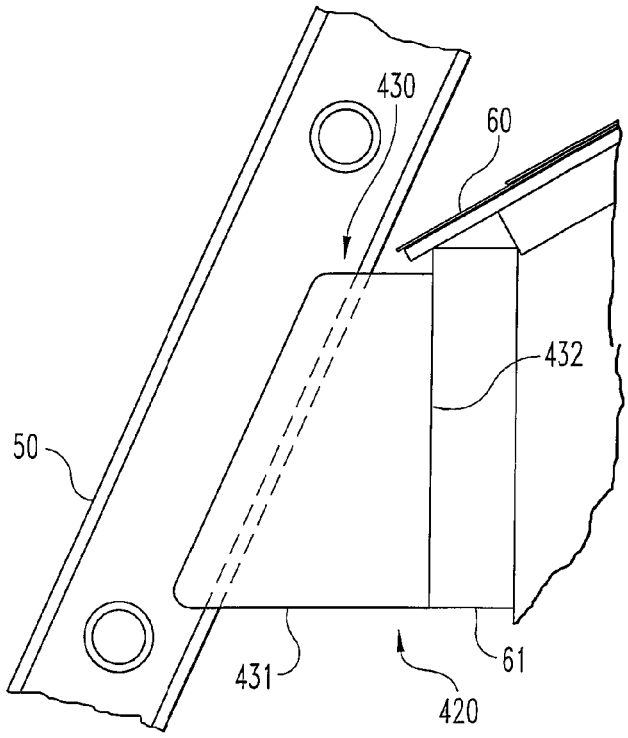
FIG. 10 is a side view of the ladder safety device of FIG. 9 in use.

FIGS. 9-10 illustrate an additional ladder safety and stabilizing device, extender 420. Extender 420 is configured for use with structures having no gutter at the roof line. Accordingly, extender 420 repositions the ladder out from the roof line such that the ladder beams are not directly resting on the shingles to prevent damage to the shingles or other parts of the structure that the ladder may contact or be positioned against. Extender 420 defines a channel 430 configured to receive a ladder beam, such as beam 50, and includes a bottom surface 431 and a back surface 432. As illustrated, back surface 432 is configured to be positioned against a gutter board 61. In other embodiments, the back surface may be positioned against a vertical surface of the structure, just below the roof and shingles. As illustrated in FIG. 10, extender 420 functions to offset ladder beam 50 a sufficient distance out from shingles 60 to prevent the ladder from resting against the shingles and potentially causing damage thereto. It should be appreciated that extender 420 may be sized, shaped, configured, orientated and proportioned differently as would generally occur to one skilled in the art, such that the extender may be used to position the ladder at least slightly offset from the roof line, shingles or another component of the structure having no gutter. It is additionally contemplated that the extender 420 could include a securing mechanism to secure the extender and the ladder beam together. There are various types of securing mechanisms which could be used as would generally occur to one skilled in the art. As an example, a strap attached to the extender could be used to wrap around the ladder beam and secure the components together to provide added stability to the ladder during use.

Positioning the hooks or extender devices discussed above in the desired positions may occur in a variety of possible ways as would generally occur to one skilled in the art. In certain embodiments, the hooks or extender devices may be positioned in the desired positions up against the surface upon which the ladder is reaching. Thereafter, the ladder beams are positioned in the appropriate channels of the devices. In other embodiments, the hooks or extender devices may first be positioned adjacent the ladder beams, with the ladder beams positioned in the channels as desired, prior to use of the ladder. In other embodiments, the ladder may be positioned up against the surface, the user may climb the ladder carrying the hooks or extender devices, may position the hooks or extender devices as desired offset from the ladder beams, and then may move the ladder by slightly pulling the ladder away from the surface and slightly over so that the ladder beams fall into place into the channels. In some embodiments, rather than moving the ladder slightly to the side, the user may slide the hooks or extender devices straight down the ladder beams and then slightly pull the ladder out from the surface, place the hooks or extender devices in position, and then return the ladder to the surface so that the ladder beams are positioned in the channels. The previous examples are just a few of the numerous possible ways to position the hooks or extender devices as desired.

Figure 11:
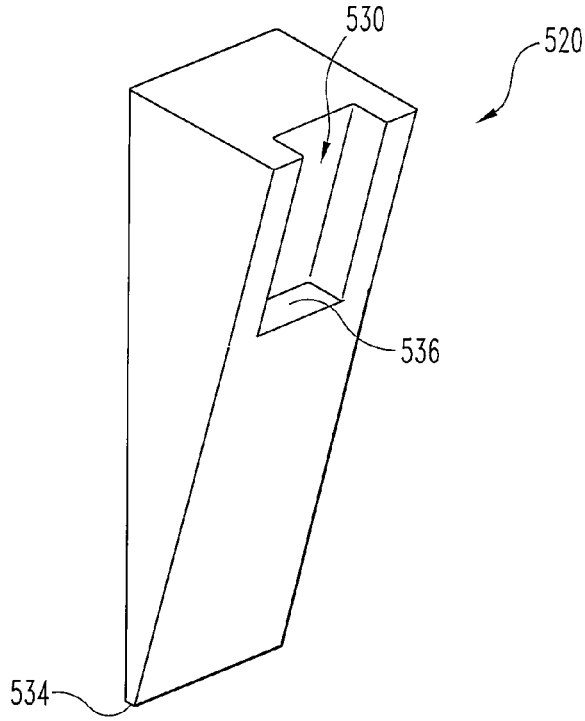
FIG. 11 is a perspective view of even a further ladder safety device.
Figure 12:
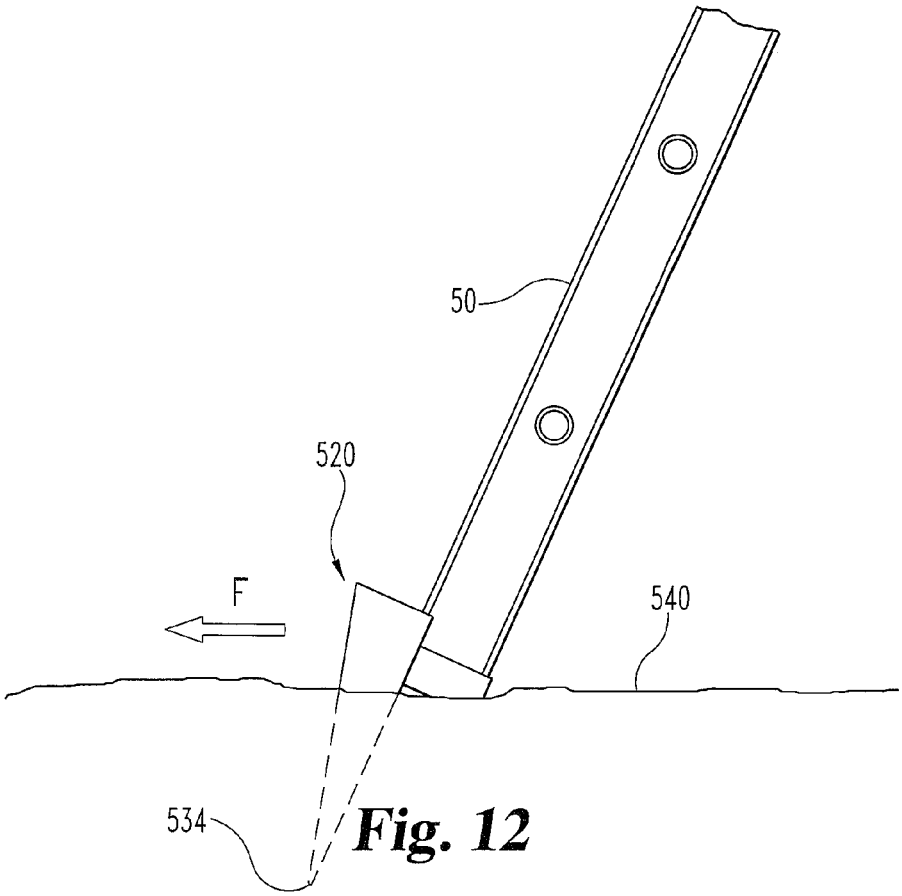
FIG. 12 is a side view of the ladder safety device of FIG. 11 in use.

Illustrated in FIGS. 11-12 is another ladder safety and stabilizing device, ground spike 520. Ground spike 520 is configured to be positioned against the bottom of the ladder beam 50 and at least partially inserted into the ground surface 540 to provide added stability to the ladder. During use, a component of the total force experienced at the bottom of the ladder is horizontal force component F urging the ladder away from the structure with which the ladder is contacting near its top end. Ground spike 520 may be used to at least partially counteract or counterbalance this force F.

Ground spike 520 defines a channel 530 configured to receive the end of the ladder beam. Spike 520 includes a bottom channel surface 536 at least partially defining channel 520. In certain embodiments, the bottom end of the ladder beam is configured to contact or rest on or abut surface 536 when the ladder beam is received in channel 530. As illustrated, ground spike 520 may be generally triangular in shape, with a spike end 534 configured to be driven into the ground. End 534 may be planar as illustrated or fully triangular. However, it should be appreciated that spike 520 may be configured different as would generally occur to one skilled in the art, so long as the ground spike is capable of being driven at least partially into the ground and positionable against the bottom of the ladder beam to provide additional support and stability to the ladder. It is additionally contemplated that the ground spike could include a securing mechanism to secure the ground spike and the bottom of the ladder beam together. There are various types of securing mechanisms which could be used as would generally occur to one skilled in the art. As an example, a strap attached to the spike could be used to wrap around the bottom of the ladder beam and secure the components together. To use ground spike 520, the ground spike may be driven into the ground either before or after the ladder beam is placed in the desired position.

Figure 13:
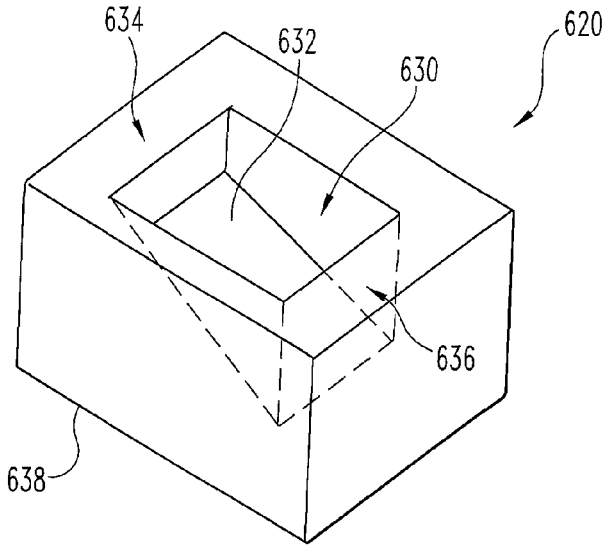
FIG. 13 is a perspective view of even yet another ladder safety device.
Figure 14:
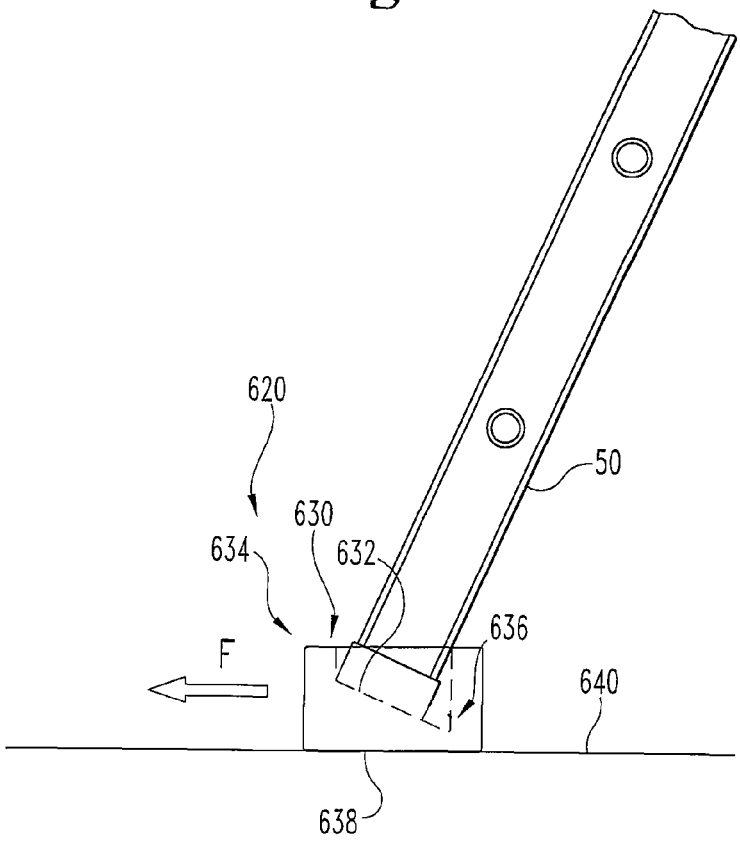
FIG. 14 is a side view of the ladder safety device of FIG. 13 in use.

FIGS. 13-14 illustrate an additional ladder safety and stability device configured to be used at the bottom of the ladder beams. Stabilizer 620 is a shoe device configured to receive the end or bottom of ladder beam 50 and designed to stabilize the ladder bottom by counteracting or counterbalancing part of the vertical force component F exerted at the bottom of the ladder beams. Stabilizer 620 defines a cavity 630 with a bottom surface 632 sloping from a higher end 634 to a lower end 636. In certain embodiments, the bottom of the ladder beam is positioned on sloping surface 632 to better distribute the forces exerted at the bottom of the ladder. Additionally, stabilizer 620 includes a bottom surface 638 preferably having a no-slip or skid-reducing feature thereon. In certain embodiments, surface 638 may be textured to reduce the likelihood of stabilizer 620 moving, sliding or skidding along a surface, such as a concrete surface 640. Additionally, it is contemplated that the stabilizer may include a retaining mechanism of some type to secure the bottom of the ladder beam within the channel of the device.

In preferred embodiments, devices 20, 120, 220, 320, 420, 520 and/or 620 may be composed of polymeric materials, such as polyurethanes, rubbers and the like. In other embodiments, the devices described in the present disclosure may be composed of wood or metal materials.

While the disclosure has been illustrated and described in detail in the drawings and foregoing description, the same is to be considered illustrative and not restrictive in character, it being understood that only certain embodiments have been shown and described and that all changes, equivalents, and modifications that come within the scope of the disclosure described herein or defined by the following claims are desired to be protected. In reading the claims, words such as "a", "an", and "at least one" are not intended to limit the claims to only one item unless specifically stated to the contrary.

The invention claimed is:

1. A gutter hook for engaging a ladder and a gutter comprising:

a member constructed from a polymeric material having a ladder portion adapted to engage with and conform to substantially an entire front face of a gutter wall an adjacent gutter portion, and a cut-out-portion proximate the gutter and ladder portion, the ladder portion having a ladder engaging channel opposite the gutter portion for receiving and maintaining a single ladder beam therein.

2. The gutter hook of claim 1, included in a kit further comprising at least two members selected from the group consisting of (a) a ladder extender; (b) a ground spike; and (c) a ladder shoe.

3. The gutter hook of claim 1, wherein the cut-out-portion is a narrow channel substantially conforming to the front face of the gutter wall and the gutter portion is adapted to fit within and fill the gutter.

4. The gutter hook of claim 3, wherein the polymeric material is a polyurethane.

5. The gutter hook of claim 4, wherein the polyurethane contains fibers.

6. The gutter hook of claim 5, wherein the fibers are in the form of a fiber network.

7. The gutter hook of claim 1, wherein the cut-out-portion is a broad channel conforming substantially to the front surface and an upper surface of the gutter and the gutter portion is adapted to fit over a leaf guard fitted onto the gutter.

8. The gutter hook of claim 7, wherein the polymeric material is a polyurethane.

9. The gutter hook of claim 8, wherein the polyurethane contains fibers.

10. The gutter hook of claim 9, wherein the fibers are in the form of a fiber network.

11. A kit having members for stabilizing a ladder comprising the gutter hook of claim 1 and at least one member selected from the group consisting of (a) a ladder extender; (b) a ground spike; and (c) a ladder shoe.

12. The kit of claim 11, wherein the members selected are constructed from a polymeric material.

13. The kit of claim 12, wherein the polymeric material is a polyurethane.

14. The kit of claim 13, wherein the polyurethane contains fibers.

15. The kit of claim 14, wherein the fibers are in the form of a fiber network.

* * * * *